US006874904B2

(12) United States Patent
Hsu

(10) Patent No.: US 6,874,904 B2
(45) Date of Patent: Apr. 5, 2005

(54) LIGHT BRIGHTNESS CHANGEABLE ELECTROLUMINESCENT DEVICE

(76) Inventor: Tai Ping Hsu, No. 25, Lane 130, Heng Hsi Road, Sansia Town, Taipei Hsien (TW)

( * ) Notice: Subject to any disclaimer, the term of this patent is extended or adjusted under 35 U.S.C. 154(b) by 72 days.

(21) Appl. No.: 10/443,688

(22) Filed: May 21, 2003

(65) Prior Publication Data

US 2004/0233658 A1 Nov. 25, 2004

(51) Int. Cl.[7] ..... F21V 9/16

(52) U.S. Cl. ..... 362/84; 362/103; 362/276; 362/802; 313/510; 313/511

(58) Field of Search ..... 362/84, 276, 802, 362/103; 313/510, 511

(56) References Cited

U.S. PATENT DOCUMENTS

| | | | | |
|---|---|---|---|---|
| 5,572,817 A | | 11/1996 | Chien | 40/544 |
| 5,722,757 A | | 3/1998 | Chien | 362/32 |
| 5,752,337 A | | 5/1998 | Chien | 40/540 |
| 5,794,366 A | | 8/1998 | Chien | 40/540 |
| 5,845,987 A | * | 12/1998 | Painter | 362/206 |
| 5,879,069 A | * | 3/1999 | Chien | 362/103 |
| 5,902,688 A | * | 5/1999 | Antoniadis et al. | 428/690 |
| 5,945,911 A | * | 8/1999 | Healy et al. | 340/573.1 |
| 5,957,564 A | * | 9/1999 | Bruce et al. | 362/84 |
| 6,010,742 A | * | 1/2000 | Tanabe et al. | 427/66 |
| 6,030,089 A | * | 2/2000 | Parker et al. | 362/103 |
| 6,326,735 B1 | | 12/2001 | Wang et al. | 315/169.3 |
| 6,390,764 B1 | * | 5/2002 | Merlo et al. | 414/680 |
| 6,561,671 B2 | * | 5/2003 | Wang et al. | 362/154 |
| 2002/0067125 A1 | * | 6/2002 | Nogaki et al. | 313/510 |

* cited by examiner

*Primary Examiner*—Thomas M. Sember
*Assistant Examiner*—Jacob Y. Choi
(74) *Attorney, Agent, or Firm*—Charles E. Baxley

(57) ABSTRACT

An electroluminescent device includes one or more electroluminescent laminates attached onto a bottom surface of a base panel and one or more patterns attached onto an upper surface of the base panel. The patterns each may include two or more spaces having different material of different brightnesses to generate light of different brightness through the different materials when the electroluminescent laminate is energized. The patterns may include one or more outer peripheral spaces formed around the other inner peripheral surfaces, to generate light of different brightnesses.

4 Claims, 4 Drawing Sheets

LIGHT BRIGHTNESS CHANGEABLE ELECTROLUMINESCENT DEVICE

BACKGROUND OF THE INVENTION

1. Field of the Invention

The present invention relates to an electroluminescent device, and more particularly to an electroluminescent device having light changeable structure or having lights that may be changed to different brightnesses.

2. Description of the Prior Art

Various kinds of typical light devices have been developed for attaching onto various objects, such as shoes, cycles, etc., in order to generate warning or decorative lights or patterns. The typical light devices comprise a number of light bulbs or the like for generating lights. However, the light bulbs occupy a great-size or volume that may greatly increase the volume of the light devices and that is adverse for both transportation and storing purposes.

The other typical electroluminescent devices have also been developed for attaching onto various objects, and comprise electroluminescent light panel segments or materials that may be arranged in planar structure and that may occupy a relatively smaller volume.

For example, U.S. Pat. No. 5,572,817 to Chien, U.S. Pat. No. 5,722,757 to Chien, U.S. Pat. No. 5,752,337 to Chien, U.S. Pat. No. 5,794,366 to Chien disclose several of the typical electroluminescent devices. However, the electroluminescent light materials are directly energized to generate lights, such that the patterns are fixed or predetermined and may not be changed to different brightness.

U.S. Pat. No. 6,326,735 to Wang et al. discloses another typical electroluminescent display panel which includes a number of branch portions arranged corresponding to various patterns or luminescent laminates to be lighted that may have different colors. However, the luminescent laminates each may also emit a specific color while energized, such that the patterns or the luminescent laminates are also fixed or predetermined and may not be changed to different brightness.

Furthermore, most of the typical electroluminescent devices comprise one or more batteries that are solidly embedded within the containers and that may not be changed with the other ones by the users, such that the typical electroluminescent devices should be discarded away when the batteries are damaged or consumed. Some of the batteries may even be damaged or wetted before the typical electroluminescent devices have been sold to the users.

The present invention has arisen to mitigate and/or obviate the afore-described disadvantages of the conventional light devices or electroluminescent devices.

SUMMARY OF THE INVENTION

The primary objective of the present invention is to provide an electroluminescent device including a light or brightness changeable structure for changing to different brightnesses.

The other objective of the present invention is to provide an electroluminescent device including one or more batteries that may be easily changed by the users themselves, for allowing the working life of the electroluminescent device to be greatly increased.

In accordance with one aspect of the invention, there is provided an electroluminescent device comprising a base panel including an upper surface and a bottom surface, at least one electroluminescent laminate attached onto the bottom surface of the base panel, a pattern attached onto the upper surface of the base panel, and including a first space and at least one second space provided thereon, a first material applied onto the first space of the pattern, a second material applied onto the second space of the pattern, and including a brightness different from that of the first material, and means for energizing the electroluminescent laminate to generate light through the pattern, and to generate light of different brightness through the first material and the second material.

The second space is preferably provided around the first space of the pattern. The first material may be selected from quartz powder, mercury powder or crystal powder materials. The second material may be selected from quartz powder, mercury powder or crystal powder materials.

A film may further be provided and applied onto either or both the upper surface and the lower surface of the base panel, to shield the pattern or to shield the electroluminescent laminate.

The energizing means includes a circuit board electrically coupled to the electroluminescent laminate, and at least one battery attached to the circuit board to energize the electroluminescent laminate. The base panel includes a first coupler coupled to the electroluminescent laminate, and a second coupler coupled to the circuit board for coupling to the first coupler of the base panel.

One or more conductor bars may further be provided and electrically connected to the electroluminescent laminate. The circuit board includes at least one processor and an inverter disposed thereon and coupled with each other, the inverter is coupled to the electroluminescent laminate.

A switch device may further be provided and attached to the circuit board, in order to control or actuate the electroluminescent laminate. For example, the switch device may be a rolling beads sensor to detect movements or vibrations or slightly touches of the housing or objects, in order to selectively energize the electroluminescent laminate when the switch device is touched or actuated.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
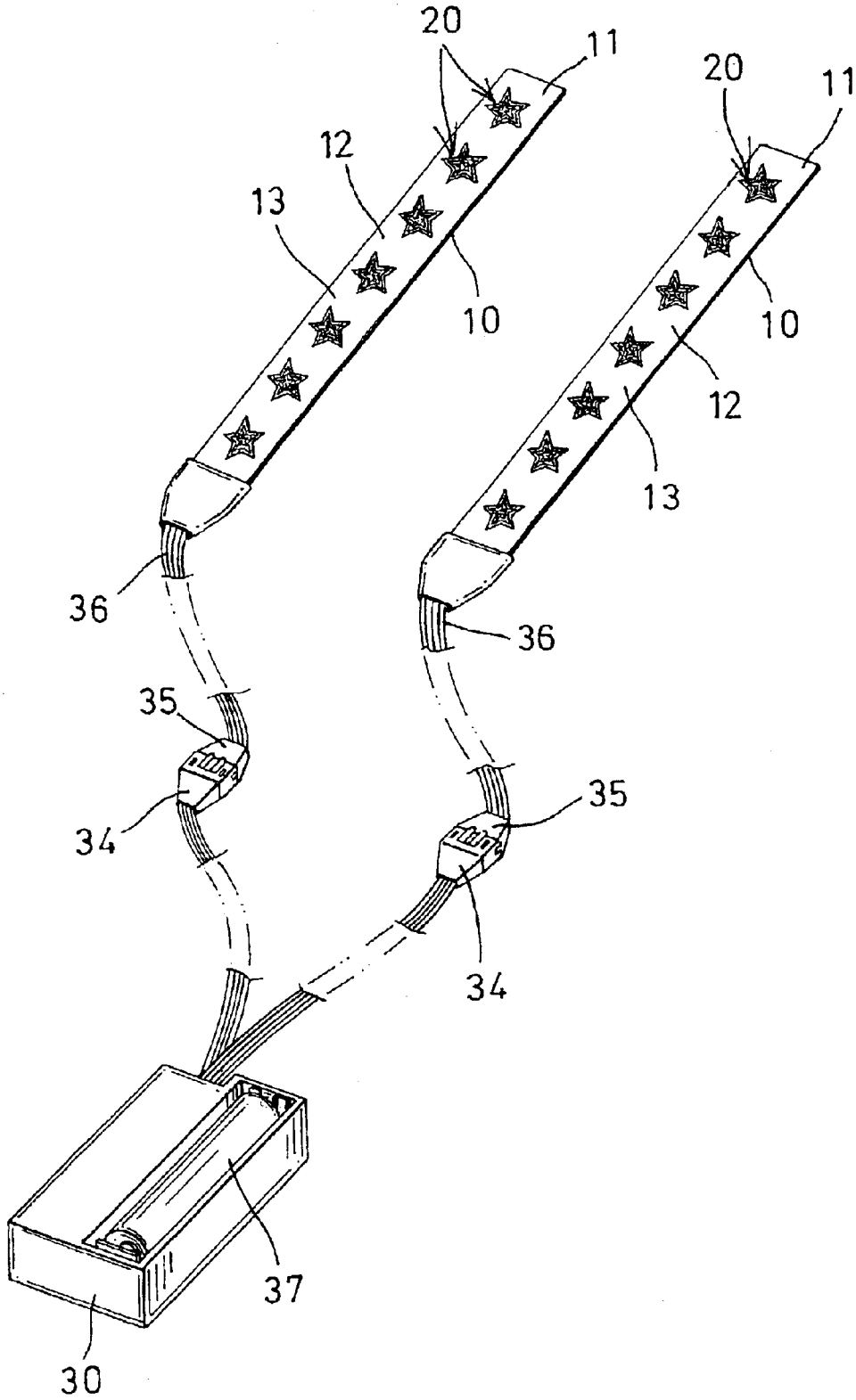
FIG. 1 is a perspective view of an electroluminescent device in accordance with the present invention.
Figure 2:
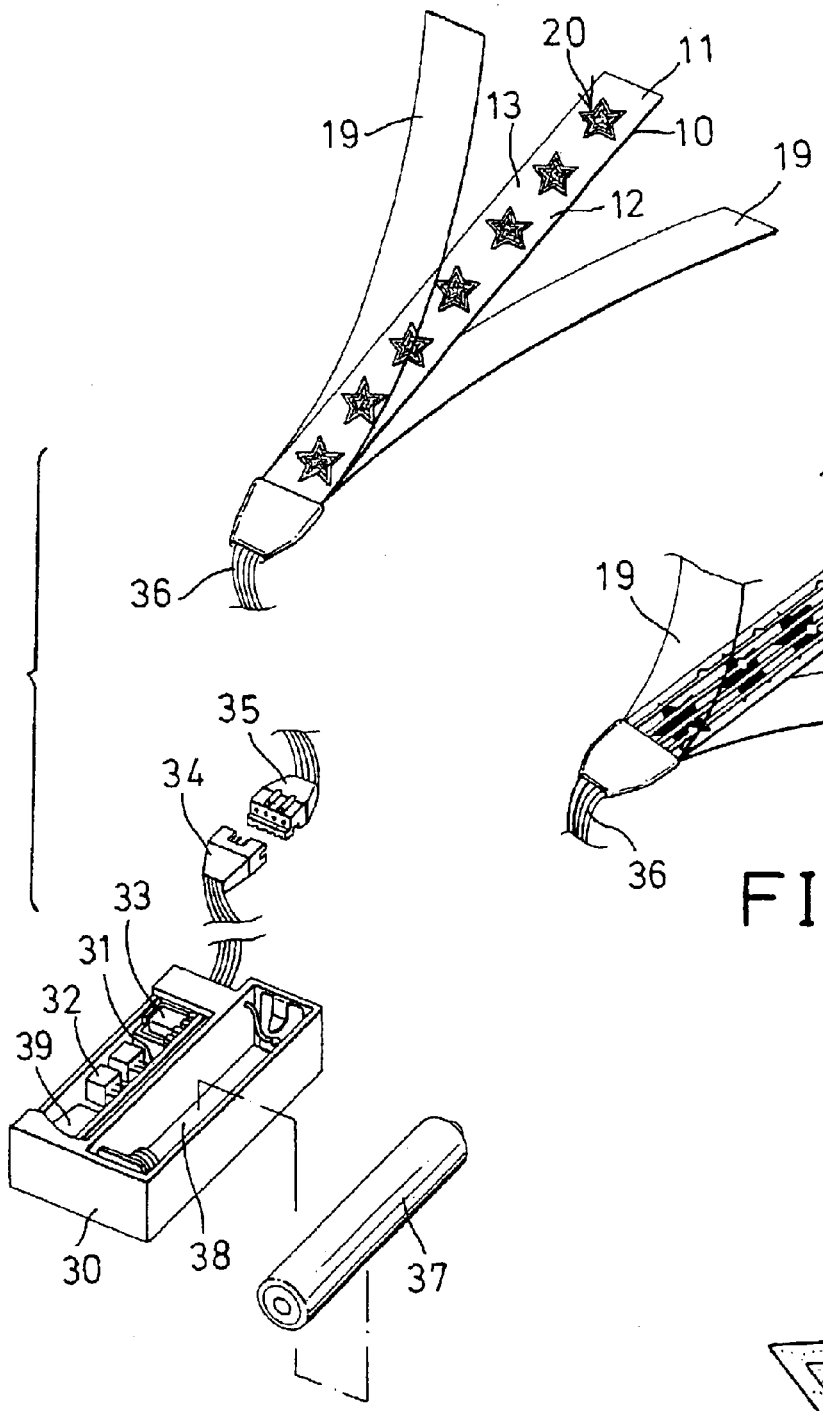
FIG. 2 is a partial exploded view of the electroluminescent device.
Figure 3:
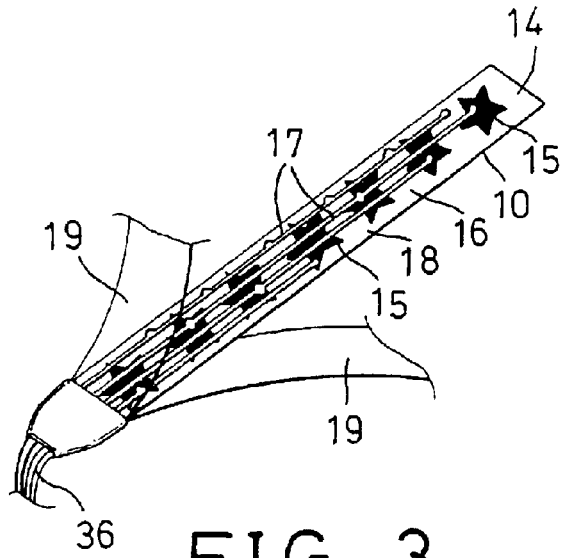
FIG. 3 is a perspective view illustrating the bottom portion of the light member of the electroluminescent device.

Referring to the drawings, and initially to FIGS. 1–3, an electroluminescent device in accordance with the present invention comprises one or more base panels 10 preferably made of electrically insulated and/or transparent or semi-transparent materials, such as poly vinyl chloride (PVC) materials, or other synthetic materials. The base panels 10 each may be formed into various shapes or contours for attaching onto various objects, such as shoes, bags, backpacks, etc.

The base panel 10 includes one surface, such as the upper surface 11 having one or more patterns 20 applied thereon, and having one or more spaces or areas 12 formed or defined between the patterns 20, and preferably (but not necessarily) applied with an opaque material or layer or painting 13 for allowing light to emit through the patterns 20 only. The patterns 20 may be formed into various kinds of shapes or contours, such as the star-shape as shown in the drawings.

As shown in FIG. 3, the base panel 10 includes an opposite surface, such as the lower surface 14 having one or more light or electroluminescent laminates 15 applied thereon, and located corresponding to or aligned with the patterns 20 that are provided on the upper surface 11 of the base panel 10, and includes one or more spaces or areas 16 formed or defined between the electroluminescent laminates 15, and preferably (but not necessarily) applied with an insulating material or layer or painting 18 thereon.

The electroluminescent laminates 15 are made of materials that may generate light or electroluminescence when energized, such as tungsten powder materials, in order to generate and emit light through the base panel 10 and the patterns 20. The electroluminescent laminates 15 may be formed into various shapes or contours that are different from that of the patterns 20, but preferably formed into the shapes or contours identical or similar to that of the patterns 20 and aligned with the patterns 20.

It is preferable that the electroluminescent laminates 15 includes an area equals to or greater than that of the patterns 20, for allowing the light or electroluminescence generated by the electroluminescent laminates 15 to suitably emit through the base panel 10 and the patterns 20.

One or more wires or cables or conductor bars 17 are attached or applied onto the bottom surface 14 of the base panel 10, and each electrically connected with one or more electroluminescent laminates 15, for coupling the electroluminescent laminates 15 to electric power sources. The conductor bars 17 and the electroluminescent laminates 15 may be applied onto the base panel 10 similar to the typical printed circuit boards.

A transparent or semi-transparent film 19 may further be provided and applied or attached onto the upper surface 11 or the lower surface 14 of the base panel 10, and engaged onto the patterns 20 and/or the opaque material or layer or painting 13; or onto the electroluminescent laminates 15 and/or the conductor bars 17 and/or the insulating material or layer or painting 18, in order to protect the patterns 20 and the electroluminescent laminates 15 and/or the conductor bars 17.

The electroluminescent device further includes a housing 30, a circuit board 31 disposed in the housing 30, one or more integrated circuits or processors 32 disposed on the circuit board 31, an inverter 33 disposed on the circuit board 31, and coupled to the processors 32, and coupled to one or more couplers 34.

The panels 10 may each include a coupler 35 coupled to the electroluminescent laminates 15 and/or the conductor bars 17 with wires or cables 16, and selectively coupled to the couplers 34 for electrically coupling the electroluminescent laminates 15 and/or the conductor bars 17 to the circuit board 31. one or more batteries 37 may be engaged into a chamber 38 of the housing 30, for energizing the processors 32 and/or the inverter 33 and/or the other electric elements.

A switch device 39, such as a rolling beads sensor, a spring oscillating switch, or the like, may further be provided and attached to the circuit board 31, in order to energize the electroluminescent laminates 15 and/or the conductor bars 17 when the housing 30 is touched by the users, or when the housing 30 is moved or shacked or vibrated by various outer forces or the like; i.e., the switch device 39 may detect the shakes or touches in order to energize the electroluminescent laminates 15 and/or the conductor bars 17.

Figure 4:
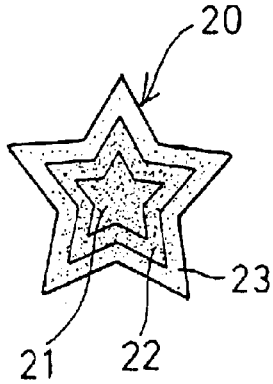
FIG. 4 is a plan schematic view illustrating one of the patterns of the electroluminescent device.

As shown in FIG. 4, the patterns 20 each may include two or more areas or spaces 21, 22, 23 formed or applied with different materials of different brightnesses. For example, the pattern 20 may include one of the spaces 21-23 (such as the innermost space 21) made or formed with metallic powder materials or mercury powder that may generate less brightness, one of the intermediate spaces 22 made or formed with such as crystal powder that may generate greater brightness, and another space 23 (such as the outermost space 23) made or formed with such as quartz powder that may generate the greatest brightness.

Accordingly, when the light generated by the electroluminescent laminates 15 emits through the spaces 21–23 of the pattern 20, lights of different brightnesses may be generated. The spaces 21–23 of the pattern 20 may also be applied with the other powder materials or layers, such as the other precious metallic powder materials, that are different from the mercury powder, the quartz powder, and the crystal powder.

It is preferable that the outer space 23 is provided around the outer peripheral portion of the pattern 20, and arranged around the inner space 21 and/or the intermediate space 22 of the pattern 20, and the intermediate space 22 is provided around the inner space 21 of the pattern 20, for allowing the light emitted through the spaces 21–23 of the pattern 20 may generate lights that have gradually changed brightnesses from the inner portion toward the outer peripheral portion, or from the outer peripheral portion toward the inner portion thereof.

Similarly, either the inner space 21 or the intermediate space 22 may be applied with the brightest quartz powder, and/or either the outer space 23 or the intermediate space 22 may be applied with the mercury powder, and/or either the inner space 21 or the outer space 23 may be applied with the crystal powder, in order to generate lights of different brightnesses.

Figure 6:
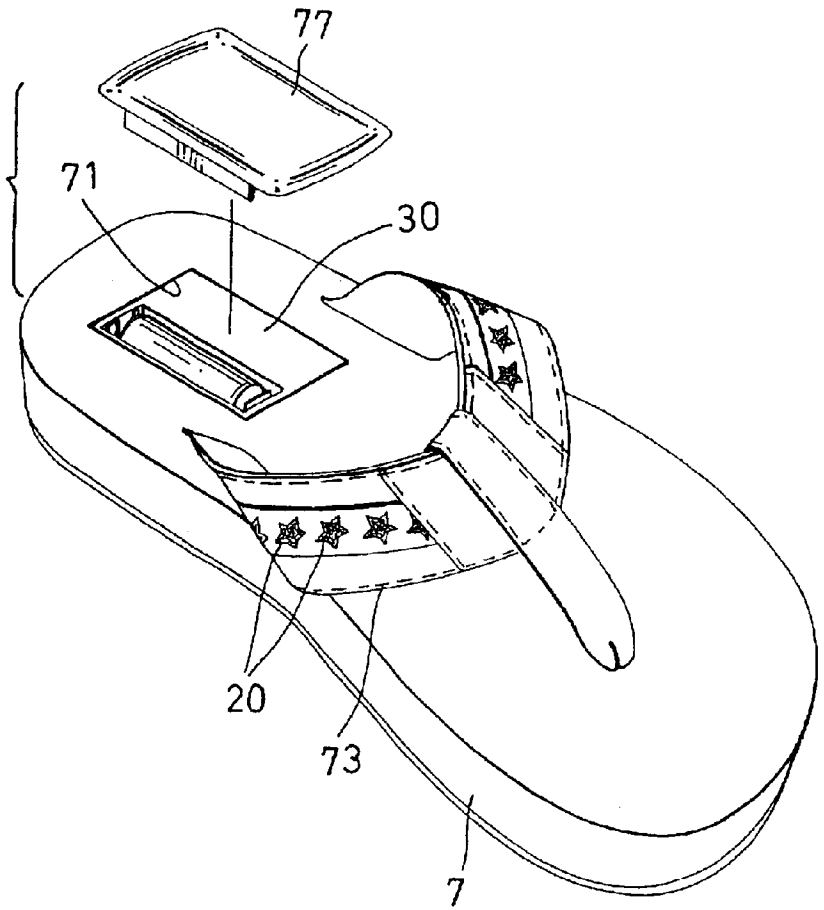
FIGS. 5, 6, 7 are partial exploded views illustrating the operation of the electroluminescent device.
Figure 5:
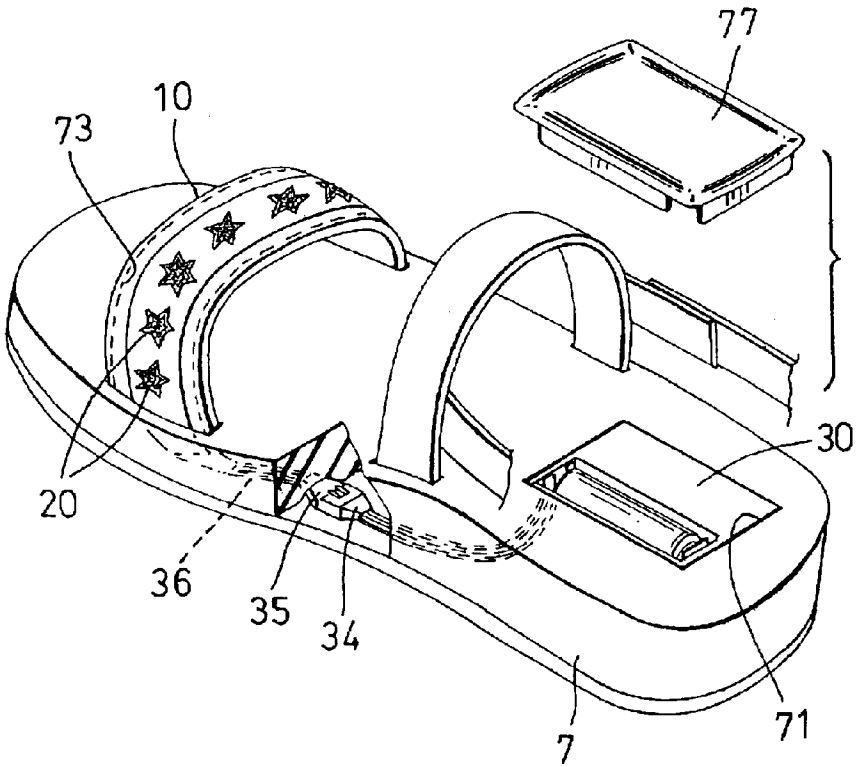
Figure 7:
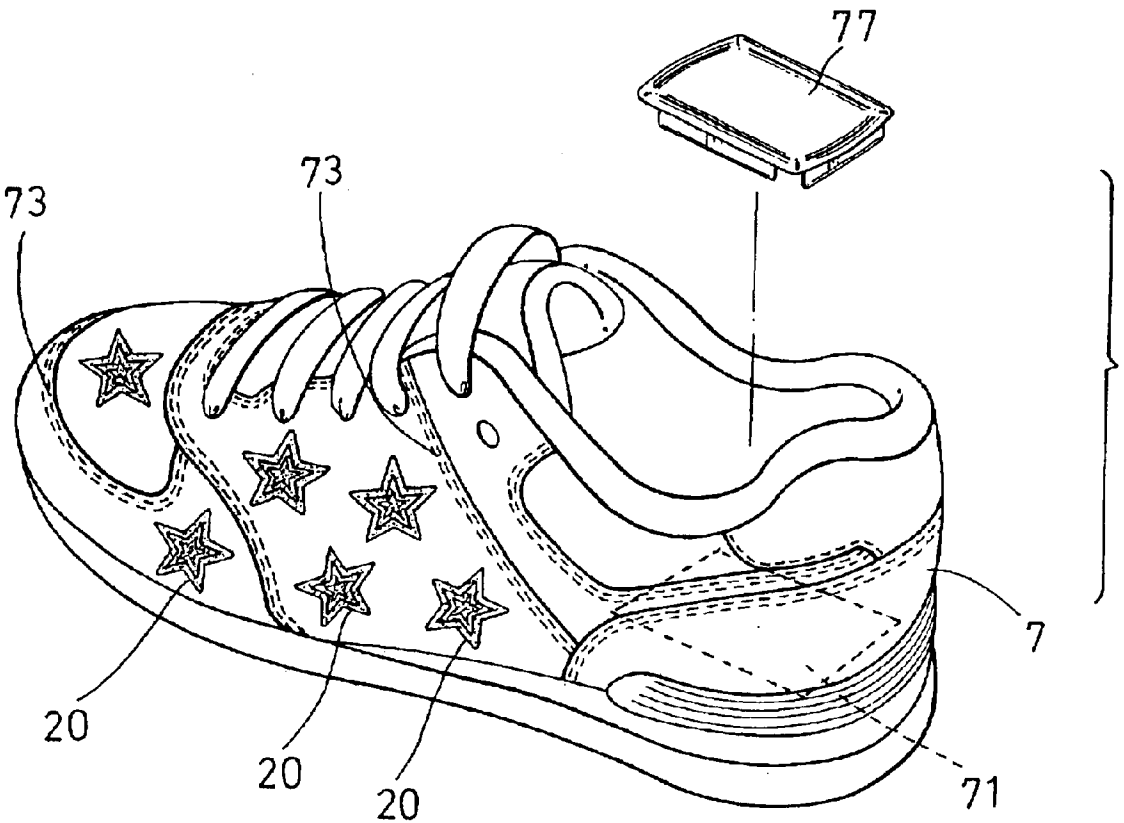

In operation, as shown in FIGS. 5–7, the electroluminescent device may be attached onto various objects, such as shoes 7. For example, the shoe 7 may include a cavity 71 formed therein to receive the housing 30. The base panels 10 may be attached onto various portions of the shoes 7 with such as stitches 73, adhesive materials, or by welding processes, or the like.

A cover 77 may further be provided to enclose or shield the cavity 71 of the shoes 7. Lights of different brightnesses may thus be generated through the patterns 20 when the shoes 7 are moved or even touched by the users or the like. The batteries 37 may be easily changed by the users themselves, such that the electroluminescent device is not required to be discarded away when the batteries have been damaged or consumed.

Accordingly, the electroluminescent device in accordance with the present invention includes a light changeable structure for changing to different brightnesses or for generating lights of different brightnesses, and/or includes a battery that may be changed according to the users' need, so as to increase the working life of the electroluminescent device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electroluminescent device comprising:

a base panel including an upper surface and a bottom surface, at least one electroluminescent laminate attached onto said bottom surface of said base panel, a pattern attached onto said upper surface of said base panel, and including a first space, a second space, and a third space provided thereon, said third space being provided around said second space of said pattern to have said second space arranged within said third space, and said second space being provided around said first space of said pattern to have said first space arranged within said second space, a mercury powder material applied onto said first space of said pattern, for generating less brightness, a crystal powder material applied onto said second space of said pattern, and including a brightness greater than that of said mercury powder material, a quartz powder material applied onto said third space of said pattern, and including a brightness greater than that of said crystal powder material, a film applied onto said upper surface of said base panel, to shield said pattern, a film applied onto said bottom surface of said base panel, to shield said at least one electroluminescent laminate, means for energizing said at least one electroluminescent laminate to generate light through said pattern, and to generate light of different brightness through said mercury powder material and said crystal powder material and said quartz powder material, a quartz powdermaterial, said energizing means including a circuit board electrically coupled to said at least one electroluminescent laminate, and at least one battery attached to said circuit board to energize said at least one electroluminescent laminate, said circuit board including at least one processor and an inverter disposed thereon and coupled with each other, said inverter being coupled to said at least one electroluminescent laminate, and a switch device attached to said circuit board, in order to control said at least one electroluminescent laminate.

2. The electroluminescent device as claimed in claim 1, wherein said base panel includes a first coupler coupled to said at least one electroluminescent laminate, and a second coupler coupled to said circuit board for coupling to said first coupler of said base panel.

3. The electroluminescent device as claimed in claim 1, wherein said switch device is a rolling beads sensor.

4. The electroluminescent device as claimed in claim 2 further comprising at least one conductor bar electrically connected to said at least one electroluminescent laminate.

* * * * *